US005764225A

United States Patent [19]

Koshobu

[11] Patent Number: 5,764,225

[45] Date of Patent: Jun. 9, 1998

[54] LIQUID CRYSTAL DISPLAY WITH TWO SEPARATE POWER SOURCES FOR THE SCAN AND SIGNAL DRIVE CIRCUITS

[75] Inventor: Nobuaki Koshobu, Kariya, Japan

[73] Assignee: Nippondenso Co., Ltd., Kariya, Japan

[21] Appl. No.: 569,982

[22] Filed: Dec. 8, 1995

[30] Foreign Application Priority Data

Jan. 13, 1995 [JP] Japan ..... 7-004455

[51] Int. Cl.[6] ..... G09G 5/00

[52] U.S. Cl. ..... 345/211; 345/98

[58] Field of Search ..... 345/210, 211, 345/212, 213, 95, 97, 98, 99, 100, 52, 204, 205; 315/168–169.4

[56] References Cited

U.S. PATENT DOCUMENTS

| | | | |
|---|---|---|---|
| 4,748,444 | 5/1988 | Arai . | |
| 5,130,703 | 7/1992 | Fairbanks et al. | 345/211 |
| 5,363,118 | 11/1994 | Okumura | 345/211 |
| 5,414,443 | 5/1995 | Kanatani et al. | 345/95 |
| 5,510,748 | 4/1996 | Erhart et al. | 345/211 |
| 5,528,256 | 6/1996 | Erhart et al. | 345/211 |
| 5,574,475 | 11/1996 | Callahan, Jr. et al. | 345/211 |
| 5,576,737 | 11/1996 | Isozaki | 345/211 |

FOREIGN PATENT DOCUMENTS

| | | |
|---|---|---|
| 1-200394 | 8/1989 | Japan . |
| 1200394 | 8/1989 | Japan . |
| 4-182694 | 6/1992 | Japan . |
| 5-119746 | 5/1993 | Japan . |
| 5-46954 | 7/1993 | Japan . |
| 5-333815 | 12/1993 | Japan . |

*Primary Examiner*—Steven Saras
*Assistant Examiner*—Paul A. Bell
*Attorney, Agent, or Firm*—Cushman Darby & Cushman IP Group of Pillsbury Madison & Sutro LLP

[57] ABSTRACT

A scanning signal from a scanning electrode drive circuit and a data signal from a signal electrode drive circuit are applied to a liquid crystal panel to perform image display in the liquid crystal panel. Here, as well as power supply to the scanning electrode drive circuit and the signal electrode drive circuit being from separate power supply circuits, a voltage for producing a data signal in the liquid crystal drive voltage power supply circuit is generated with a central voltage of a liquid crystal drive voltage power supply circuit, which is for generating a voltage for producing the scanning signal, as a reference voltage. Because power is supplied separately to the scanning electrode drive circuit and the signal electrode drive circuit, the breakdown voltage of the signal electrode drive circuit is alleviated and thus power consumption is reduced, and further, flickering does not occur in the display, etc., even if there are fluctuations in the power supply voltage.

12 Claims, 15 Drawing Sheets

VEE1
Vwp
Vhp
Y1
Ve
Vhn
Vwn
VSS1

VEE1
Vwp
Vhp
Y2
Ve
Vhn
Vwn
VSS1

VEE1
Vwp
Vhp
Y3
Ve
Vhn
Vwn
VSS1

VEE2
V1
Xi
V4
VCOM
V5
V8
VSS2
BRIGHT(%)
100 87.5 75.0 62.5
100 87.5 75.0 62.5

| | | | | | | | | |
|---|---|---|---|---|---|---|---|---|
| Y1 | -H | E | +S | +H | E | -S | -H | |
| Y2 | +H | E | -S | -H | E | +S | +H | |
| Y3 | -H | E | +S | +S | E | -S | -H | |

VEE1
Vwp
Vhp
Y1
Ve
Vhn
Vwn
VSS1

VEE2
V1
Xi
VCOM
V4
V5
V8
VSS2
D1,i D2,i D3,i D4,i D5,i
D1,i D2,i D3,i D4,i D5,i
PIXEL

RCK

DP

STD

RCK

DAP
D1,1
D1,2
D1,m

STD

SIC

VEE2
Xi VCOM
VSS2
L1 L2 L3 L4 L5 L1 L2 L3 L4 L5
NL1 NL2 NL3 NL4 NL5 NL1 NL2 NL3 NL4 NL5
PIXEL DATA
FIG. 14B SHS
FIG. 14C DP
FIG. 14D STD
FIG. 14E DE
FIG. 14F 911a L1 * L3 * L5 *
FIG. 14G 911b NL1 * NL3 * NL5 *
FIG. 14H 911c L2 * L4 * L6
FIG. 14I 911d NL2 * NL4 * NL6
FIG. 14J STD
FIG. 14K HCK1
FIG. 14L HCK2
FIG. 14M HCK3
X1 X2 X3 X4 X5 X6 Xm-3 Xm-2 Xm-1 Xm

LIQUID CRYSTAL DISPLAY WITH TWO SEPARATE POWER SOURCES FOR THE SCAN AND SIGNAL DRIVE CIRCUITS

CROSS-REFERENCE TO RELATED APPLICATIONS

This application is related to and claims priority from Japanese Patent Application No. Hei. 7-4455, incorporated herein by reference.

BACKGROUND OF THE INVENTION

1. Field of the Invention

The present invention relates to a matrix-type liquid crystal display device which performs matrix display using liquid crystals such as antiferroelectric liquid crystals or the like.

2. Description of the Related Art

A conventional matrix-type liquid crystal device using antiferroelectric liquid crystals is disclosed in Japanese Patent Laid-Open Publication No. Hei. 5-119746. The overall structure of this prior art example is shown in FIG. 15. In that device, in a liquid crystal panel 10 filled with antiferroelectric liquid crystals, stripe-shaped scanning electrodes and signal electrodes are arranged and formed intersecting each other. Then, a scanning signal is applied to the stripe-shaped scanning electrodes Y1–Yn from a scanning electrode drive circuit 20 to select a scanning electrode. Synchronously with this selection, a data signal corresponding to image data for performing display in pixels on the selected scanning electrode is applied to the signal electrodes X1–Xm by signal electrode drive circuit 30. By means of these scanning and data signals, image display is performed in the liquid crystal panel 10 by way of a line sequence scan driving system.

The scanning electrode drive circuit 20, as well as receiving five types of voltages from a liquid crystal drive voltage power supply circuit 40, also produces and outputs the above scanning signal (refer to Y1–Y3 in FIGS. 16A–16C) based on a control signal form a control circuit 60. Also, a signal electrode drive circuit 30, as well as receiving eight types of voltages from a liquid crystal drive voltage power supply circuit 50, receives an image data signal DAP and outputs the above data signal (refer to Xi in FIG. 16D) based on a control signal from the control circuit 60.

Note that output of the eight types of voltages in the liquid crystal drive voltage power supply circuit 50 is for performing image display having half-tones (refer to the brightness scale under FIG. 16D). Here, according to the structure of the above prior art example, power supply to the scanning electrode drive circuit 20 and the signal electrode drive circuit 30 is from a common power supply circuit 70.

In the case of a liquid crystal display device using antiferroelectric liquid crystals, in order for the scanning electrode drive circuit 20 to output a voltage on the order of $60V_{P_P}$, as a liquid crystal drive voltage, a power supply voltage higher than this output voltage is supplied to the scanning electrode drive circuit 20. Also, in order to use the power supply voltage for both the signal electrode drive circuit 30 and the scanning electrode drive circuit 20, a breakdown voltage which can sufficiently withstand this power supply voltage is needed in the signal electrode drive circuit 30.

However, because the signal electrode drive circuit 30 can only output a maximum voltage on the order of $20V_{P_P}$ as a liquid crystal drive voltage, operating it at the same power supply voltage as the scanning electrode drive circuit 20 is wasteful in terms of energy consumption even at the breakdown voltage. Also, the requirement of a high breakdown voltage to the signal electrode drive circuit 30 is an obstacle to high integration in the case of producing a monolithic integrated circuit.

Here, providing separate power supply circuits for the scanning electrode drive circuit 20 and the signal electrode drive circuit 30 has been considered. In such cases, since a necessary minimum voltage can be supplied to the drive circuits of each, the breakdown voltage of the signal electrode drive circuit 30 can also be set at a necessary minimum and energy consumption can be reduced. Also, where the signal electrode drive circuit is produced as a monolithic integrated circuit, high integration thereof is easy.

However, where power supplies are separated in this way, problems such as the following occur. Although the voltage between the scanning electrodes and the signal electrodes is applied to the liquid crystals, as well as flickering occurring in the display where there is a direct current voltage component in this voltage, there is also the possibility of deterioration of the liquid crystals. Where a common voltage is supplied to the scanning electrode drive circuit 20 and to the signal electrode drive circuit 30 as in the prior art drive circuit, a direct current voltage component is not applied to the liquid crystals due to fluctuations in the output voltages of both the scanning electrode drive circuit 20 and the signal electrode drive circuit 30, even if the power supply voltage fluctuates.

In contrast to this, where separate power is supplied to the scanning electrode drive circuit 20 and the signal electrode drive circuit 30, if the power supply voltages of the electrode drive circuits fluctuate, since the output voltages thereof fluctuate separately, a direct current voltage component is supplied to the liquid crystals.

SUMMARY OF THE INVENTION

The present invention was devised in light of the above problems, and has as one object to avoid application of a direct current voltage component to the liquid crystals even when the power supply voltages fluctuate where power supply circuits are separately provided as described above, thus preventing flickering in the display and deterioration of the liquid crystals. Also, the present invention has as a second object to supply separate power sources for the scanning electrode drive circuit and the signal electrode drive circuit and to solve the above-described problems of breakdown voltage, power consumption and the like.

The above objects are achieved in a first aspect of the present invention by providing a liquid crystal display device in which, as power supply to the scanning electrode drive circuit and the signal electrode drive circuit being performed from separate power supply circuits, the central voltage of the scanning signal and the central voltage of the data signal are made to conform. Consequently, even where the power supply voltages supplied to each electrode drive circuit fluctuate, because each of the signals applied to the liquid crystals do not fluctuate relative to each other due to the matching of the central voltage of the scanning signal and the central voltage of the data signal, direct current voltage components are not supplied to the liquid crystals and flickering in the display and deterioration of the liquid crystals can be prevented.

Also, by separating the power supply circuits to each of the drive circuits, the power supply voltages supplied to each of the drive circuits can be kept to a necessary minimum.

Consequently, in such a case the breakdown voltage required for the signal electrode drive circuit can be alleviated and power consumption reduced. Further, the signal drive circuit can easily be made as a monolithic integrated circuit and high integration can be expected.

In addition, it is preferable that voltage information indicating the state of the power supply voltage of the scanning signal power supply circuit which outputs the power supply voltage for producing the scanning signal is obtained to produce a data signal. Consequently, the scanning signal and the data signal can be associated and produced and the scanning signal and data signal applied to the liquid crystals do not fluctuate relative to each other, so that flickering in the display and deterioration of the liquid crystals can be prevented.

Further, it is possible that a circuit is provided in the signal electrode drive circuit for, when there are direct current fluctuations in the scanning signal, direct current fluctuating only the fluctuating portion of the data signal. Accordingly, because if there is a direct current fluctuation in the scanning signal, the data signal direct current fluctuates in the same manner, the scanning signal and data signal supplied to the liquid crystals do not fluctuate relative to each other and as described above flickering in the display and deterioration in the liquid crystals can be prevented.

Other objects and features of the invention will appear in the course of the description thereof, which follows.

BRIEF DESCRIPTION OF THE DRAWINGS

Additional objects and advantages of the present invention will be more readily apparent from the following detailed description of preferred embodiments thereof when taken together with the accompanying drawings in which:

FIG. 14A–14M are operation timing charts of the signal 10 electrode drive circuit shown in FIG. 11;

DETAILED DESCRIPTION OF THE PRESENTLY PREFERRED EXEMPLARY EMBODIMENTS

The preferred embodiments of the present invention are hereinafter described with reference to the accompanying drawings.

Figure 1:
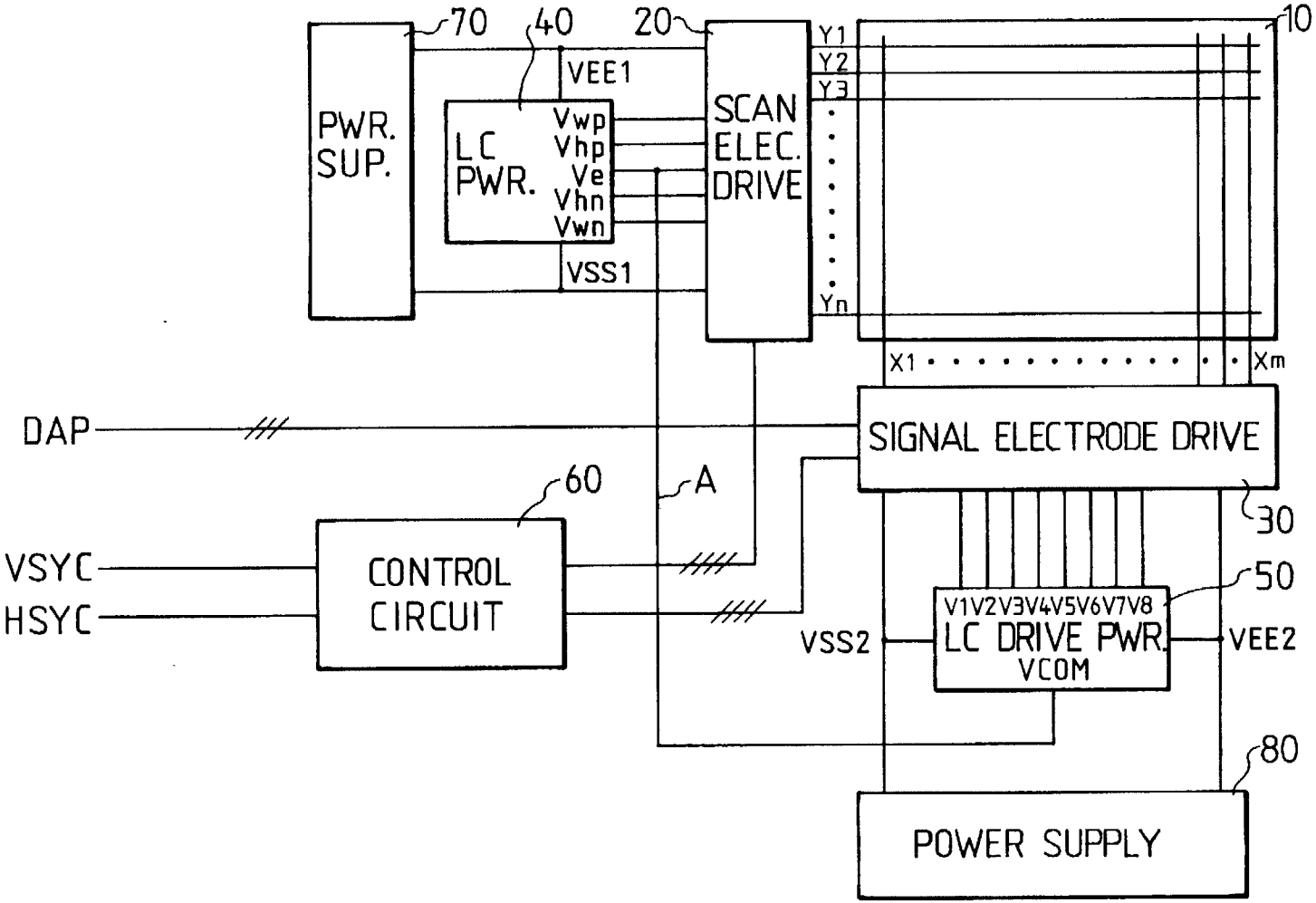
FIG. 1 is an overall structural diagram showing the entire structure of a liquid crystal display device according a first embodiment of the present invention.
Figures 2A, 2B, 2C, 2D:
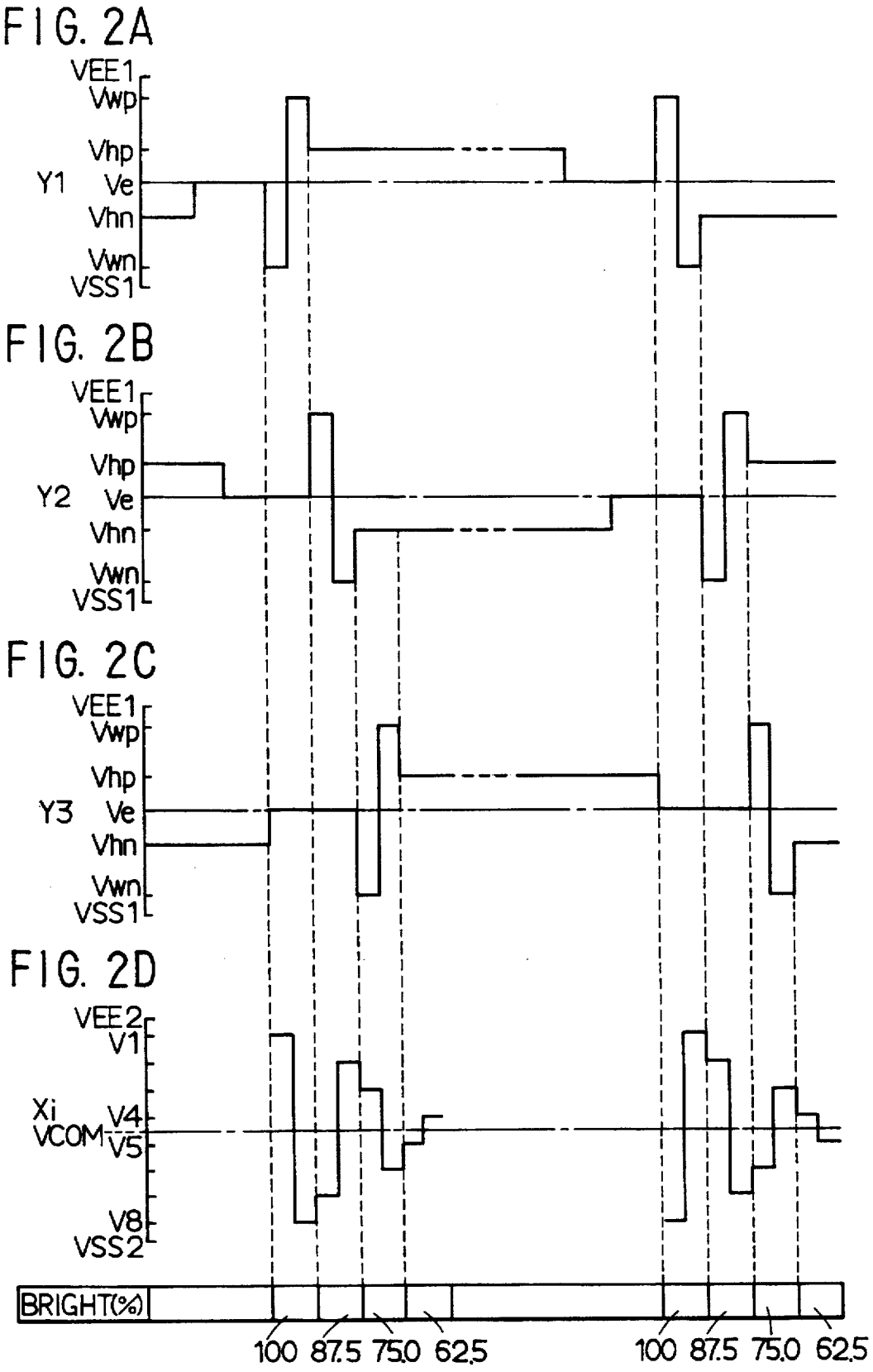
FIGS. 2A–2D are waveform diagrams showing the waveforms of a scanning signal and a data signal in the first embodiment.

FIG. 1 shows the structure of an entire matrix-type liquid crystal display device according to a first embodiment of the present invention. A liquid crystal panel 10 has n stripe-shaped scanning electrodes Y1–Yn and m stripe-shaped signal electrodes X1–Xm, a scanning signal from a scanning electrode drive circuit 20 being applied to the scanning electrodes Y1–Yn and a data signal from the signal electrode drive circuit 30 being applied to the signal electrodes X1–Xm. The waveforms of scanning signals Y1–Y3 are shown in FIGS. 2A–2C, respectively, and data signal Xi is shown in FIG. 2D.

An image data signal DAP for performing image display is input to the signal electrode drive circuit 30 and the above data signal is produced by means of this image data signal DAP. In the present embodiment, in order to perform eight grey level display for performing eight-level brightness control, this image data signal DAP is a 3-bit per pixel data signal. Also, a vertical synchronization signal and a horizontal synchronization signal for performing image display are input to a control circuit 60. The control circuit 60 outputs a control signal for controlling each of the scanning electrode drive circuit 20 and signal electrode drive circuit 30 based on these synchronization signals.

Figure 3:
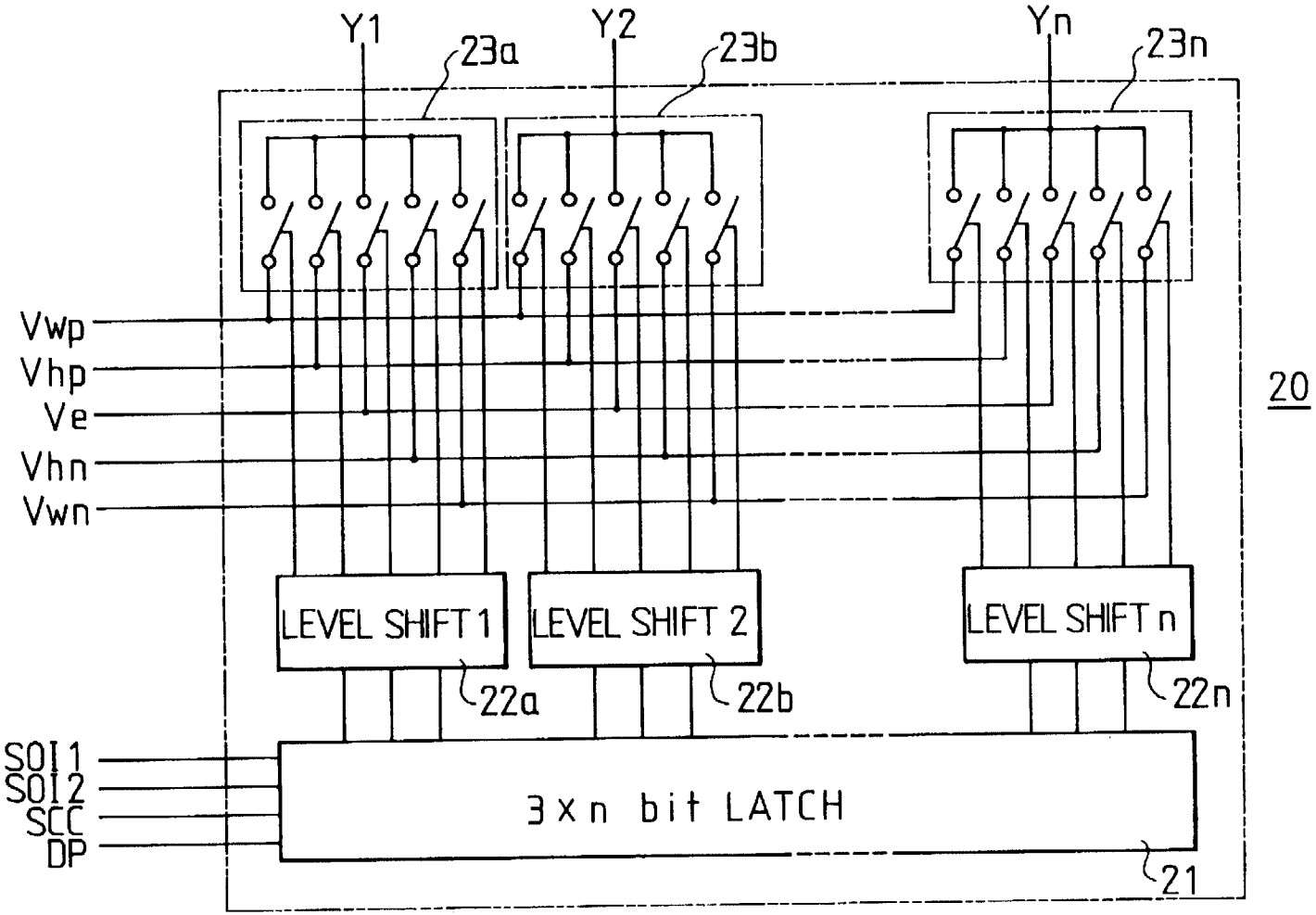
FIG. 3 is a structural diagram showing the specific structure of the scanning electrode drive circuit 20 shown in FIG. 1.

FIG. 3 shows the specific structure of the scanning electrode drive circuit 20. Also, an operation timing chart for the scanning electrode drive circuit 20 is shown in FIG. 4. The scanning electrode drive circuit 20 is constructed by a 3×n-bit data latch 21, n level shifters **22*a*–22*n* and n analog switching circuits 23*a*–23*n*** each having five analog switches.

Figure 4A:
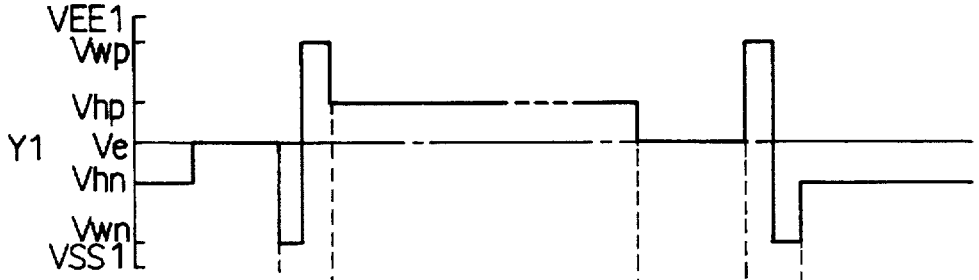
FIGS. 4A–4G are operation timing charts of the scanning electrode drive circuit shown in FIG. 3.
Figure 4B:
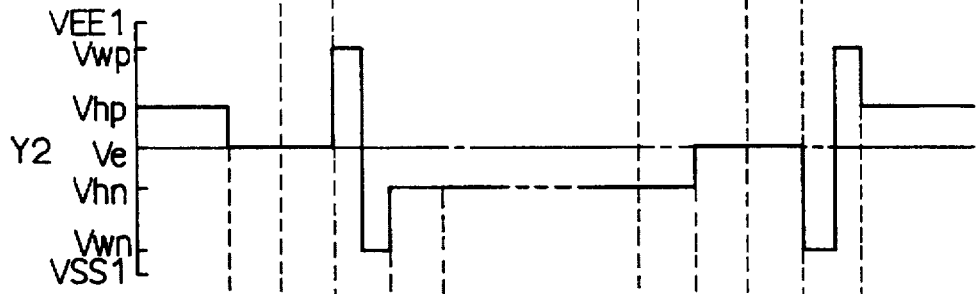
Figure 4C:
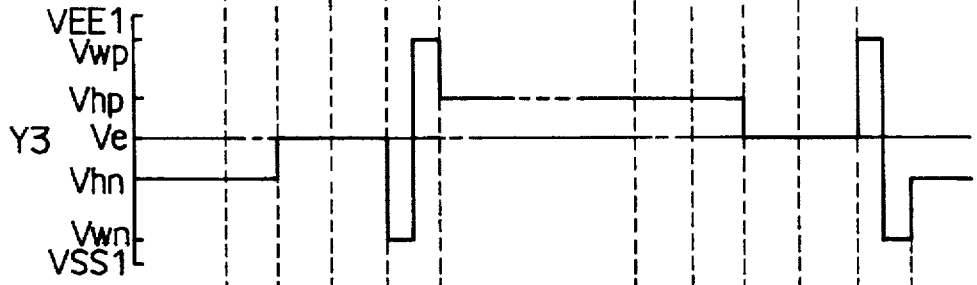
Figure 4D:
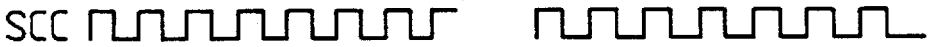

The scanning electrode drive circuit 20, as shown in FIGS. 4A–4C, sequentially outputs voltages corresponding to the states of erasure, selection and sustaining of each scanning electrode. Also, the positive and negative polarities thereof are switched at each selection period to make alternating current driving.

The operation of the scanning electrode drive circuit 20 will now be explained with the example of a scanning electrode Y1 shown in FIG. 4A. In the elimination period, a voltage Ve is output to the scanning electrode and all of the pixel display on the scanning electrode is eliminated. In the positive selection period, after a one-time minus write-in voltage Vwn is output, a plus write-in voltage Vwp is output. In the positive sustaining period a voltage Vhp is output and the display content is sustained up till the next elimination period.

The next selection period, in order to alternating current drive the liquid crystals, becomes a negative selection period of reverse polarity to the previous selection period, a one-time plus write-in voltage Vwp is output and subsequently a minus write-in voltage Vwn is output. In the negative sustaining period, a voltage Vhn is output and the display content is sustained until the next elimination period. Thereafter, the voltages of the elimination period, selection period and sustaining period are alternately repeatedly output at positive and negative polarities.

In order to sequentially scan the scanning electrodes Y1–Yn from the scanning electrode Y1, a voltage waveform whose selection period portion is shifted is applied in the scanning electrodes after and including Y2. At such time, in order to prevent flickering in the display, the voltage polarities per each scanning electrode differ so that Y1 is positive, Y2 is negative, Y3 is positive, etc., for example. In order to perform the above operation, in the specific example shown in FIG. 3, in the data latch 21 the data indicated by SOI1, SOI2, SCC and DP in FIGS. 4D–4G are input from the control circuit 60.

Figure 4E:
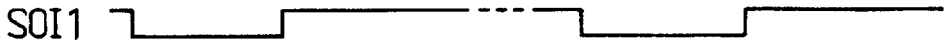
Figure 4F:
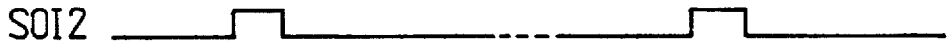

SOI1 and SOI2, shown in FIGS. 4E and 4F, respectively, are signals which specify states of the scanning electrodes and in the present embodiment they specify the states of elimination when low and low, respectively, selection when low and high, respectively, and sustaining when high and low, respectively. These signals are latched in the data latch 21 in synchronization with the rise of the timing signal SCC of FIG. 4D.

Figure 4G:
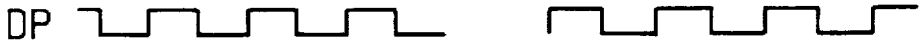

Also, the polarity of the voltage applied to the scanning electrode is determined by the DP signal shown in FIG. 4G. Namely, the DP signal is switched during the selection period with respect to each scanning electrode to determine the voltage polarity of the scanning electrode. For example, the DP signal switches from L to H in the positive selection period to switch the output voltage from Vwn to Vwp, and the DP signal switches from H to L in the negative selection period to switch the output signal from Vwp to Vwn, the input DP signal directly determining the polarity of the selected voltage. When shifting to the sustaining period, these polarities maintain their states by means of the DP signal input in the immediately preceding selection period.

Consequently, in the scanning electrode drive circuit 20, the 3×n-bit data latch 21 sequentially latches the 3-bit data of SOI1, SOI2 and DP from the control circuit 60 in synchronization with the rise of the timing signal SCC, and outputs data for controlling the scanning electrodes Y1–Yn by means of the latched data. The level shifters 22*a*–22*n* decode the output data to control the five analog switches in the analog switching circuits 23*a*–23*n*. Accordingly, the scanning signals as shown in FIGS. 2A–2C are produced by the five types of voltages produced in the liquid crystal drive voltage power supply circuit 40 and these are output to the scanning electrodes Y1–Yn.

Figure 5:
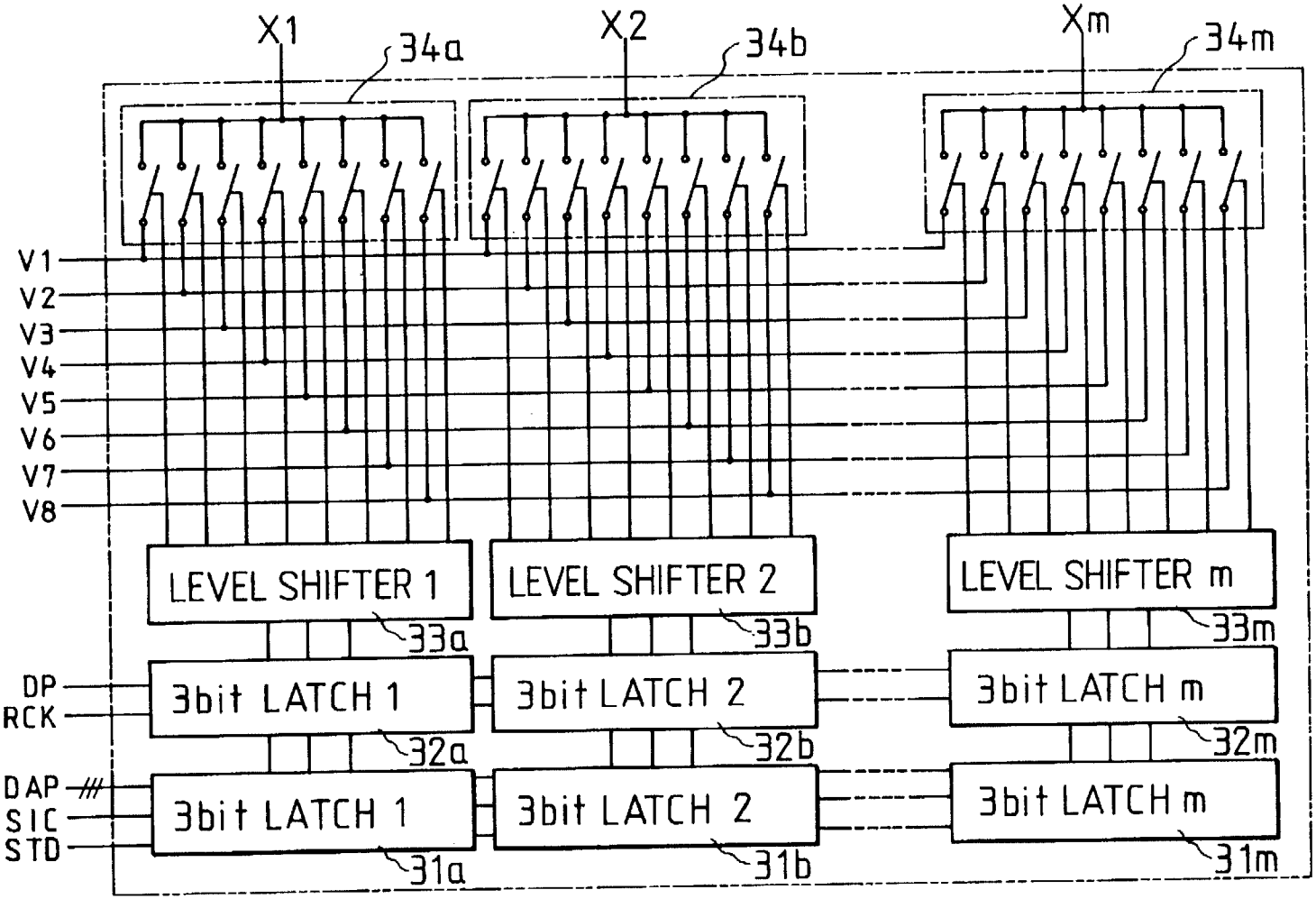
FIG. 5 is a structural diagram showing the specific structure of the signal electrode drive circuit shown in FIG. 1.

Next, the signal electrode drive circuit 30 will be explained. The specific structure thereof is shown in FIG. 5. FIG. 6A–6I show the operation timing chart thereof.

The signal electrode drive circuit 30 is constructed by dual-system 3×m bit data latches 31*a*–31*m* and 32*a*–32*m*, m level shifters 33*a*–33*m* and m analog switching circuits 34*a*–34*m* each having eight analog switches. The operation of the signal electrode drive circuit 30 will be explained below utilizing FIGS. 6A–6I.

Figures 6A, 6B, 6C, 6D, 6E, 6F, 6G, 6H, 6I:
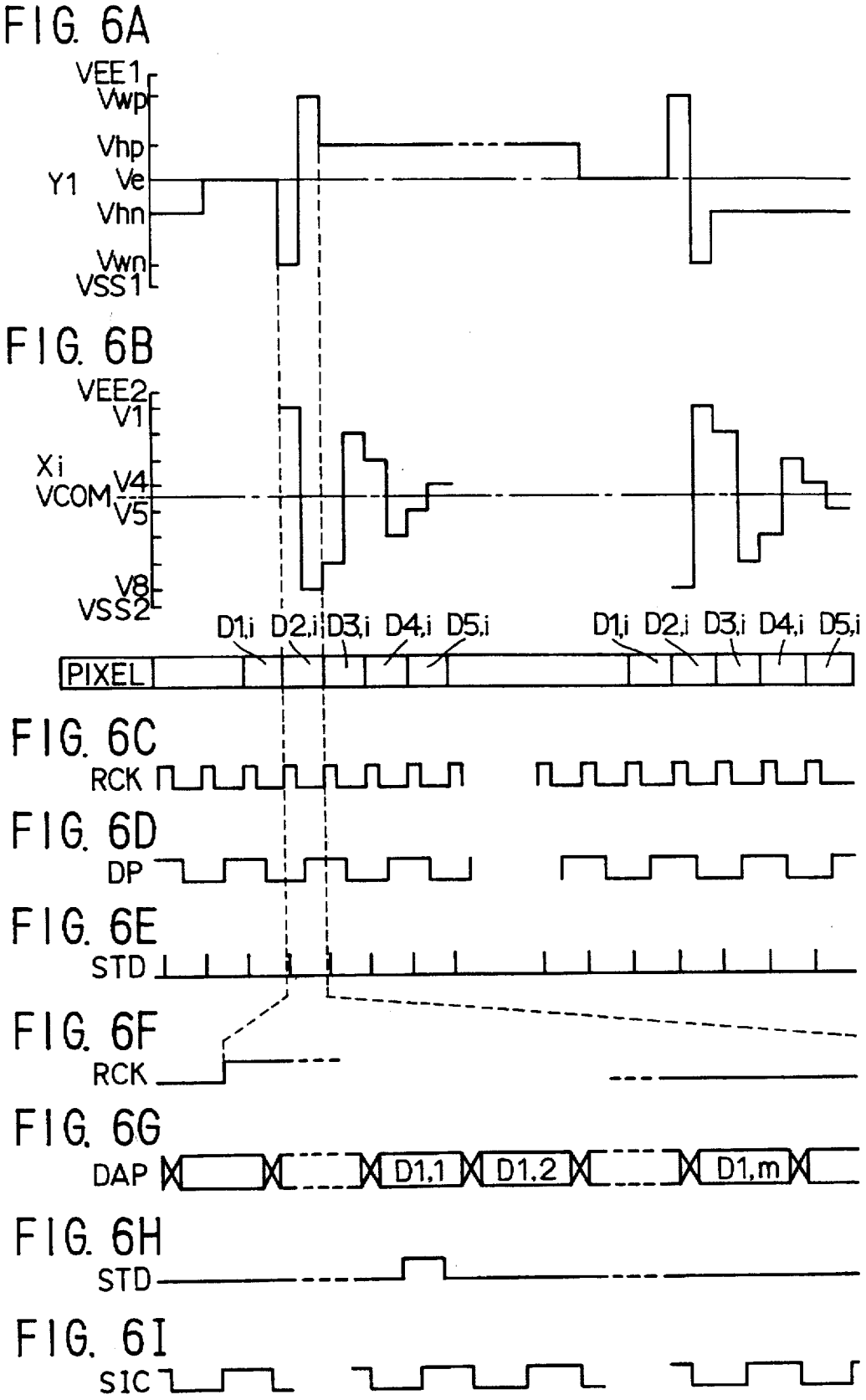
FIGS. 6A–6I are operation timing charts of the signal electrode drive circuit shown in FIG. 5.

3-bit image data signals DAP, shown in FIG. 6G, indicating eight levels of brightness, are transmitted to the signal electrode drive circuit 30 as serial data with respect to signal electrodes X1 to Xm. Also, these image data signals DAP are sequentially transmitted from the image data of pixels arrayed on the scanning electrode Y1 to the image data of pixels arrayed on the scanning electrode Yn to match the scanning of the scanning electrodes.

D1.i . . . in FIGS. 6A–6I indicate one group of image data of pixels arrayed on the scanning electrode Y1 and D1.1–m indicate data corresponding to signal electrodes X1 through Xm. Also, the data STD, SIC, RCK and DP shown in FIGS. 6C–6F from the control circuit 60 are input to the signal electrode drive circuit 30. In the structure shown in FIG. 5 the image data signals DAP are input to the 3×m bit data latches 31*a*–31*m*. In this case, image data corresponding to the signal electrode X1 when the STD signal is high are latched in synchronization with the rise of the SIC signal. Thereafter, image data corresponding to X2, X3, etc. are sequentially latched in synchronization with the rise of the SIC signal, and image data of only the pixel portions arrayed on one scanning electrode are stored in the 3×m bit data latches 31*a*–31*m* of a first system.

These image data are transferred to second system 3×m bit data latches 32*a*–32*m* in synchronization with a rise in the RCK signal. After transfer, the 3×m bit data latches 31*a*–31*m* of the first system start to latch the image data of pixels arrayed on the next scanning electrode.

In other words, as shown in the timing charts of FIGS. 6A–6I, when the STD signal is high the image data of one scanning electrode portion corresponding to the signal electrodes X1–Xn are stored in the 3×m bit data latches of the first system, and the operation of transferring them to the 3×m bit data latches 32*a*–32*m* of the second system is performed synchronously with pulses of the RCK signal, whereby data signals per each scanning line are sequentially transferred to the signal electrodes X1–Xn.

The eight analog switches in the analog switching circuits 34*a*–34*m* switch the voltages output to each of the signal electrodes from X1 to Xm. In such a case, the operations of the analog switches are determined by the image data, stored in the 3×m bit data latches 32*a*–32*m* of the second system, and DP signals. In other words, when the DP signal is low, it operates so that the analog switches connected to V8, V7, . . . V2 and V1 are switched on with respect to the 3-bit image data (0,0,0), (0, 0, 1), . . . (1, 1, 0) and (1, 1, 1) corresponding to each signal electrode output. Also, when the DP signal is high, it operates so that the analog switches connected to V1, V2, . . . V7 and V8 are switched on with respect to the 3-bit image data (0,0,0), (0, 0, 1), . . . (1, 1, 0) and (1, 1, 1) corresponding to each signal electrode output.

Consequently, the SCC and Dp signals to the scanning electrode drive circuit 20 and the RCK and DP signals to the signal electrode drive circuit 30 from the control circuit 60 are synchronized, and image data of pixels arrayed on a given scanning electrode during the selection period are input to the signal electrode drive circuit 30 before one selection period, whereby the liquid crystal drive waveforms shown in FIGS. 2A–2D are realized. Note that the liquid crystal driving structure described above is basically the same as that shown in Japanese Patent Laid-Open Publication No. 5-119746.

Here, in the above-described structure, a power supply voltage from a power supply circuit 70 is supplied to the scanning electrode drive circuit 20 and the liquid crystal drive voltage power supply circuit 40. Also, a power supply voltage from a power supply circuit 80 is supplied to signal electrode drive circuit 30 and the liquid crystal drive voltage power supply circuit 50. These power supply voltages are different voltages in consideration of breakdown voltages at the drive circuit end, power consumption, etc.

Figure 7:
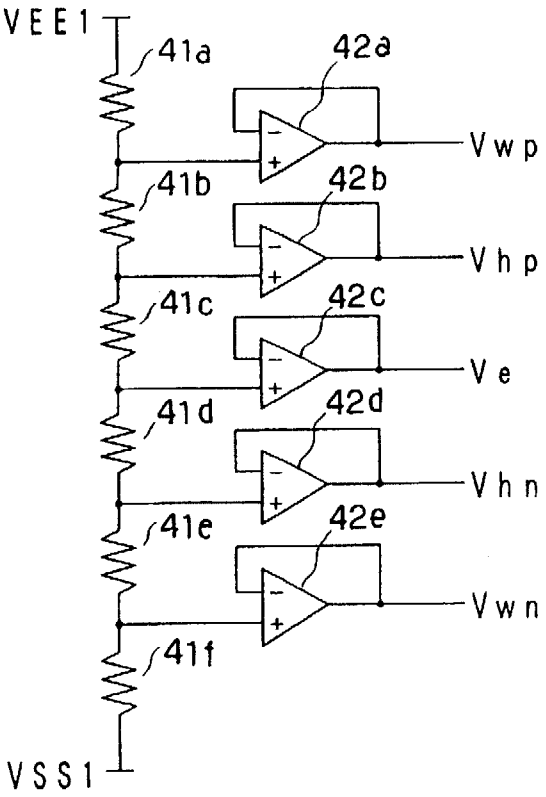
FIG. 7 is a structural diagram showing the specific structure of the liquid crystal drive voltage power supply circuit 40 shown in FIG. 1.

The liquid crystal drive voltage power supply circuit 40 has the structure shown in FIG. 7 and voltage divides the voltage supplied by the power supply circuit 70 by means of resistors 41*a*–41*f*, and outputs five types of liquid crystal drive voltages (Vwp, Vhp, Ve, Vhn and Vwn) via buffer amplifiers 42*a*–42*e*. Among these five types of the liquid crystal drive voltages, Ve is the central voltage of the other four types of voltages.

Figure 8:
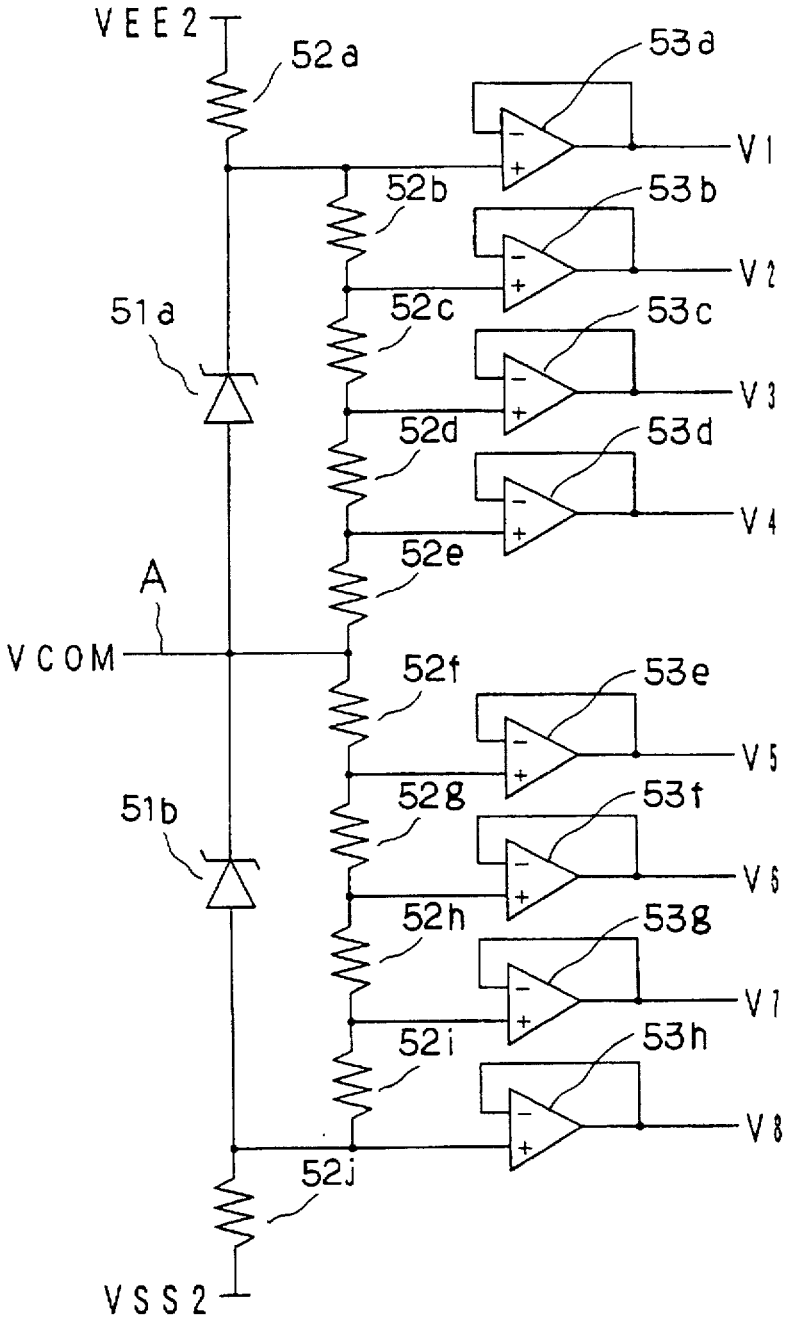
FIG. 8 is a structural diagram showing the specific structure of the liquid crystal drive voltage power supply circuit 50 shown in FIG. 1.

The liquid crystal drive voltage power supply circuit 50, having the structure shown in FIG. 8, makes the output voltage Ve of the liquid crystal drive voltage power supply circuit 40 a reference voltage VCOM (the voltage of the signal line A in the drawing), produces a stable voltage by means of two Zener diodes 51*a* and 51*b* with the above voltage Ve as a reference, and further voltage divides the reference voltage by means of resistors 52*a*–52*j* to output eight types of liquid crystal drive voltages (V1, V2, V3, V4, V5, V6, V7 and V8). As a result, the eight types of liquid crystal drive voltages are set so that the reference voltage VCOM is the central voltage.

Consequently, even where the output voltages VEE1, VSS1, VEE2 and VSS2 of the power supply circuits 70 and 80 fluctuate for example, because the liquid crystal drive voltage power supply circuit 50 is such that it produces eight types of liquid crystal drive voltages with the output voltage Ve of the liquid crystal drive voltage power supply circuit 40 as a reference voltage, the power supply voltages to the scanning electrode drive circuit 20 and the signal electrode drive circuit 30 do not fluctuate relative to each other and a direct current voltage component can be prevented from being applied to the liquid crystals.

Also, according to the embodiment described above, since power supply to the scanning electrode drive circuit 20 and to the signal electrode drive circuit 30 are performed separately, the system can utilize a minimum power supply voltage in accordance with the drive circuits, and consequently the breakdown voltage of the signal electrode drive circuit 30 can be minimized and power consumption can be reduced.

Figure 10:
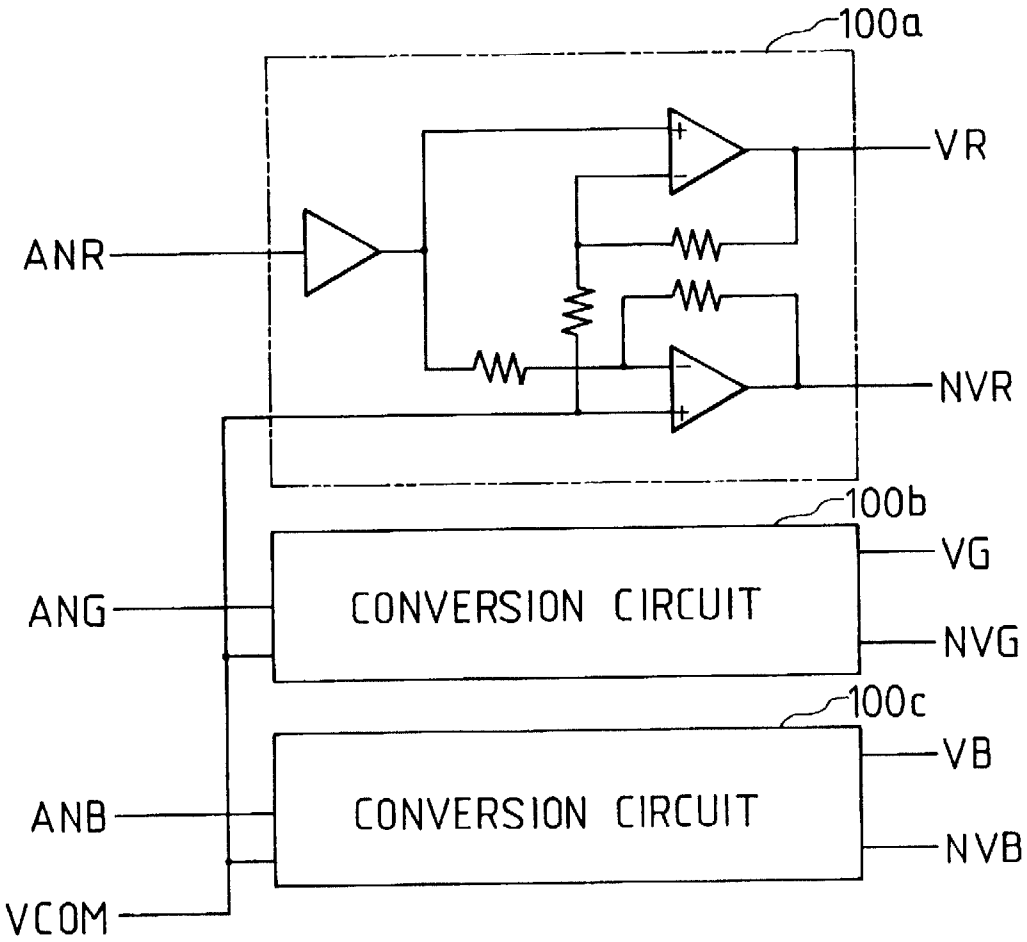
FIG. 10 is a structural diagram showing the specific structure of a level conversion circuit shown in FIG. 9.
Figure 9:
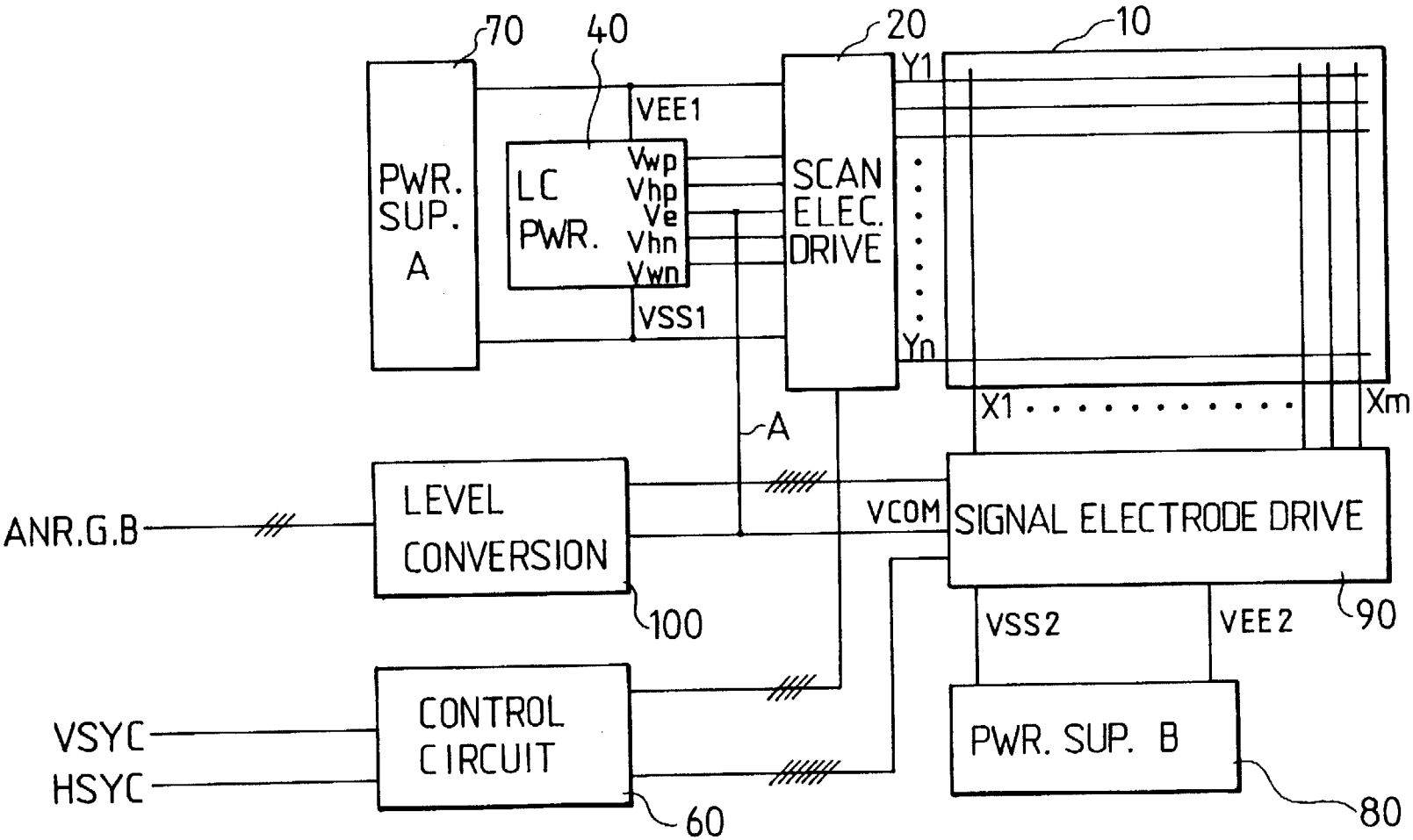
FIG. 9 is an overall structural diagram showing the entire structure of a liquid crystal display device according to a second embodiment of the present invention.

FIG. 9 shows the structure of an entire liquid crystal display device according to a second embodiment of the present invention. In the second embodiment as well as a level conversion circuit 100 being provided, this embodiment differs from the first embodiment in that the signal electrode drive circuit 30 and liquid crystal drive voltage power supply circuit 50 have been made a signal electrode drive circuit 90, but in all other aspects it is the same as the first embodiment. The specific structure of the level conversion circuit 100 is shown in FIG. 10.

The level conversion circuit 100 amplifies by A times and −A times image data signals ANR, ANG and ANB corresponding to an RGB input from an external source in non-inverting amplifiers and inverting amplifiers in conversion circuits 100*a*, 100*b* and 100*c* with the reference voltage VCOM as a reference, and outputs them as positive image signal voltages VR, VG and VB and negative image signal voltages NVR, NVG and NVB (N indicates reverse polarity). Accordingly, VR and NVR, VG and NVG and VB and NVB are respectively symmetrical voltages with the reference voltage VCOM as the center.

Figure 11:
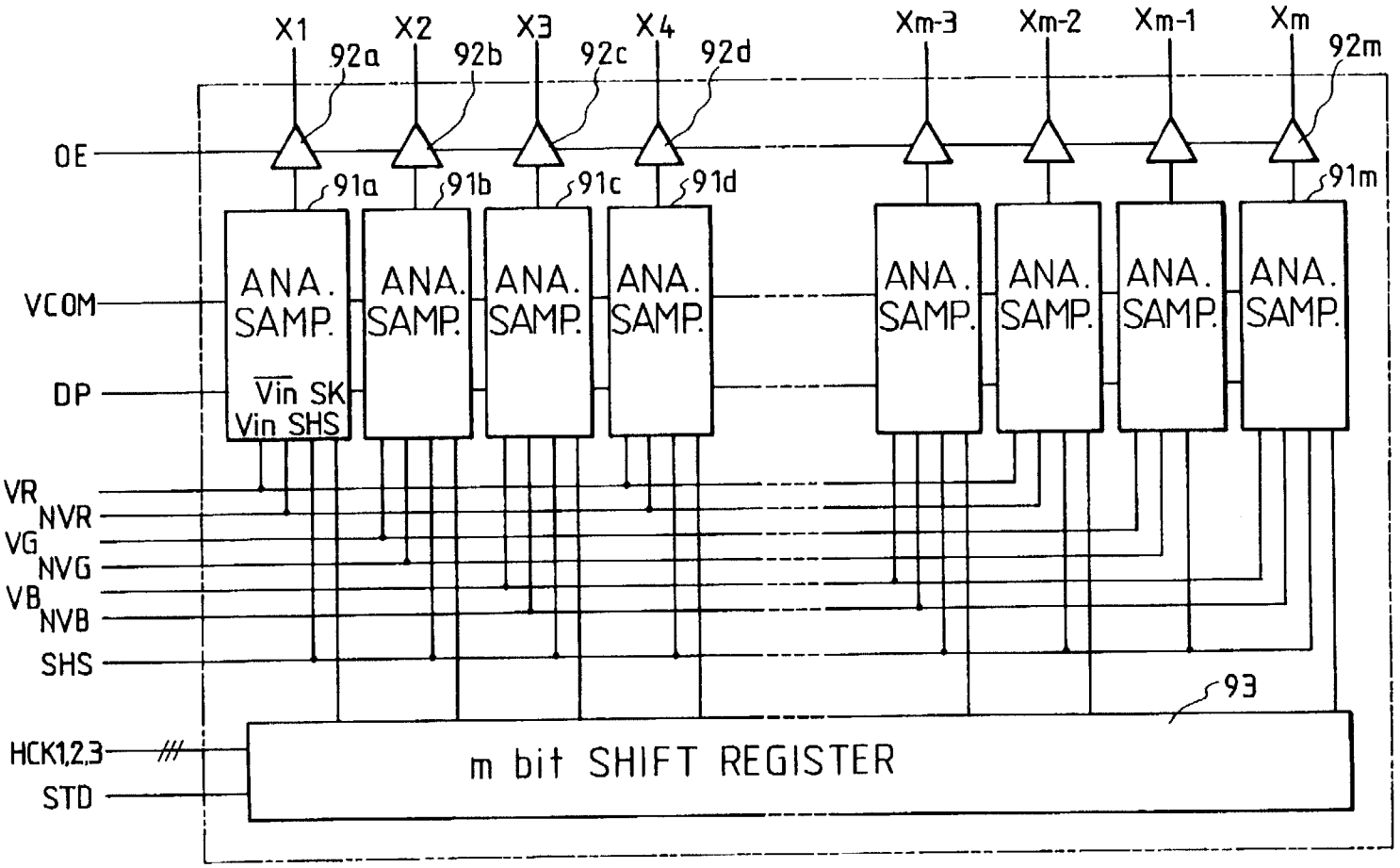
FIG. 11 is a structural diagram showing the specific structure of the signal electrode drive circuit shown in FIG. 9.

The signal electrode drive circuit 90, as shown in FIG. 11, is constructed by analog sampling circuits 91*a*–91*m*, output buffer circuits 92*a*–92*m*, and an m-bit shift register 93 for controlling the sampling timing of the analog sampling circuits 91*a*–91*m*. STD and HCK1, 2 and 3 signals are input to the m-bit shift register 93. The STD signal imposes the timing by which image data voltages per one scanning line are input, the HCK1 signal imposes sampling timing for X1, X4, X7, . . . Xm−2 image signal voltages, the HCK2 signal imposes sampling timing for X2, X5, X8, . . . Xm−1 image signal voltages, and the HCK3 signal imposes sampling timing for X3, X6, X9, . . . Xm image signal voltages.

The sampling timing is set as follows. As shown in FIGS. 14A–14M, when STD is high, the high period (when the sampling timing of the image signal voltage X1 is set) begins with the rise of HCK1. The high period of HCK1 begins with the rise in HCK2, and during this period the sampling timing of the image signal voltage X2 is set. The high period of HCK2 begins with the rise in HCK3, and that is the period in which the sampling timing of the image signal voltage X3 is set. Thereafter, the analog sampling timings of X4, X5 . . . Xm are similarly set.

Accordingly, the m-bit shift register 93 outputs to SK terminals of the analog sampling circuits 91*a*–91*m* sampling signals which impose sampling timings (refer to FIG. 14A–14M) for inputting the image signal voltages corresponding to X1–Xm for each scanning line by means of STD and HCK1, 2 and 3. In the analog sampling circuits 91*a*–91*m*, the image signal voltages VR and NVR are input to the analog sampling circuits corresponding to X1, X4, X7, . . . Xm−2, the image signal voltages VG and NVG are input to the analog sampling circuits corresponding to X2, X5, X8, . . . Xm−1, and the image signal voltages VB and NVB are input to the analog sampling circuits corresponding to X3, X6, X9, . . . Xm.

Figure 12:
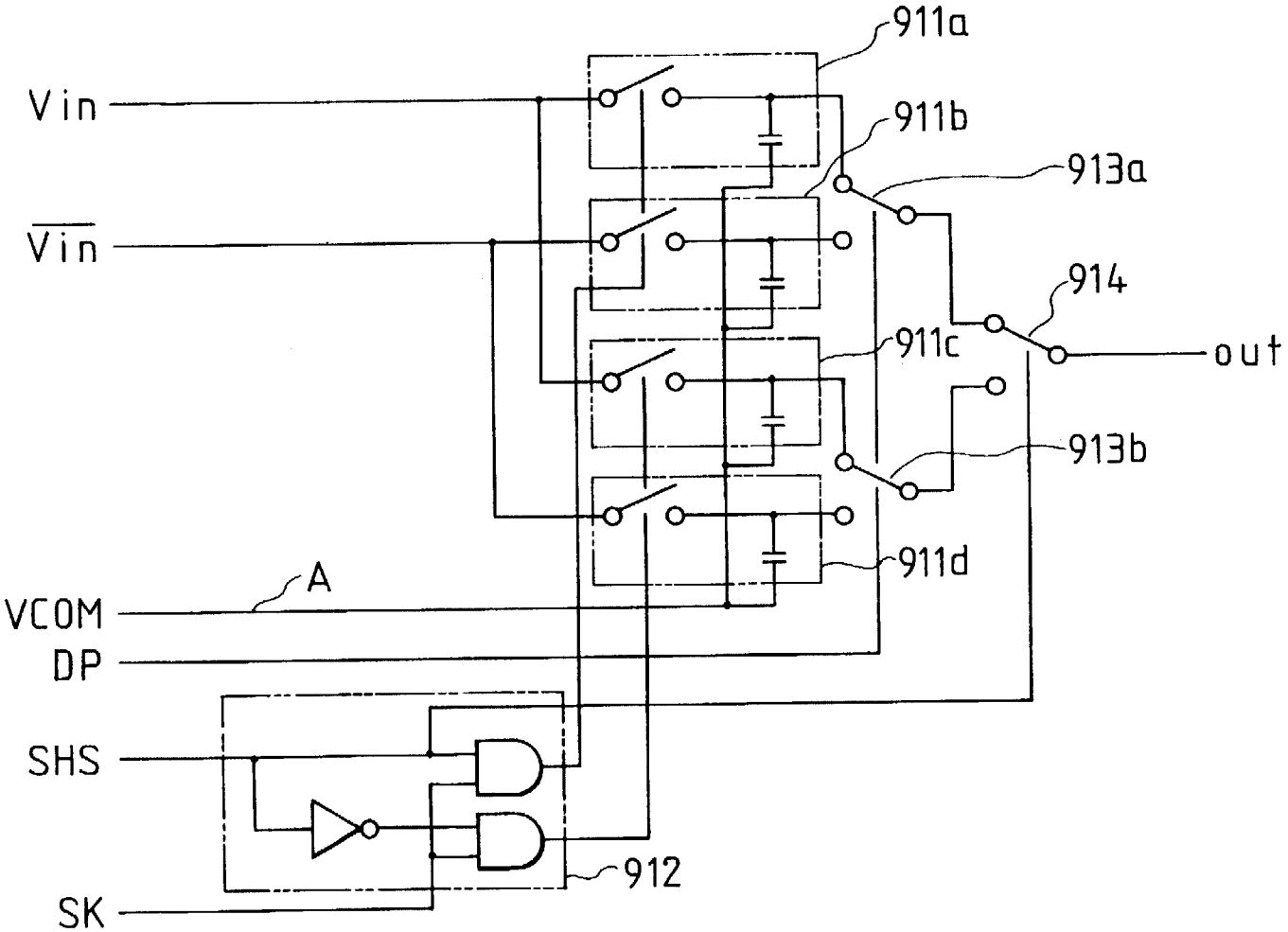
FIG. 12 is a structural diagram showing the specific structure of the analog sampling circuit shown in FIG. 11.
Figure 13A:
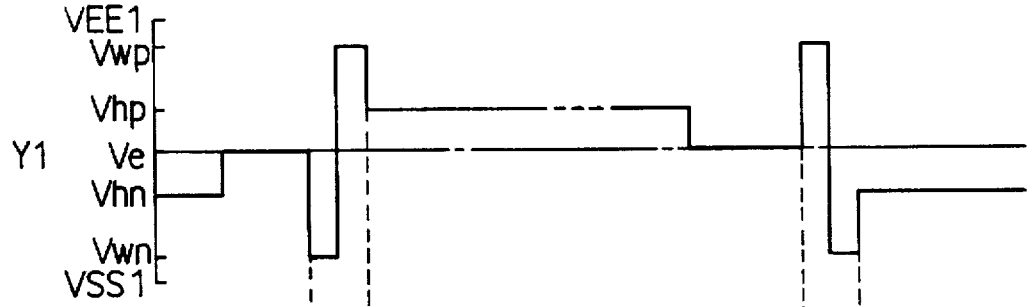
FIGS. 13A–13D are waveform diagrams showing the waveforms of a scanning signal and data signal in the second embodiment.
Figure 13B:
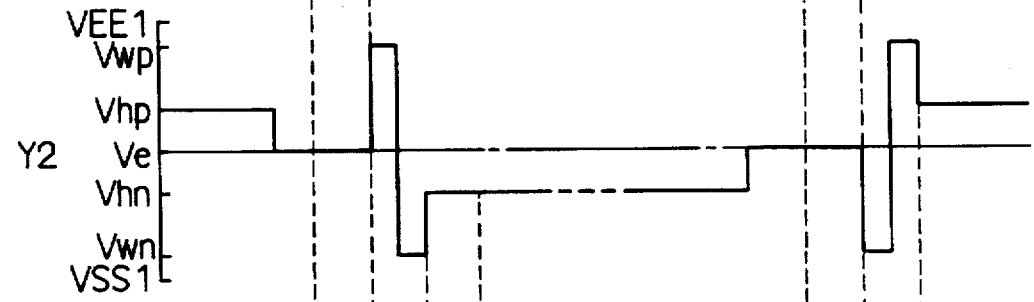
Figure 13C:
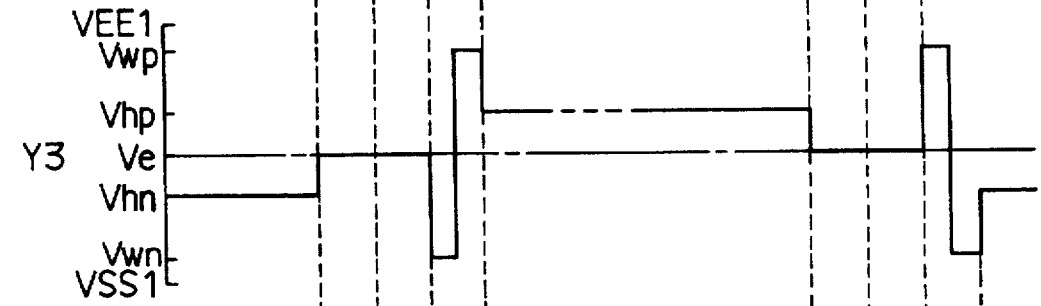
Figure 13D:
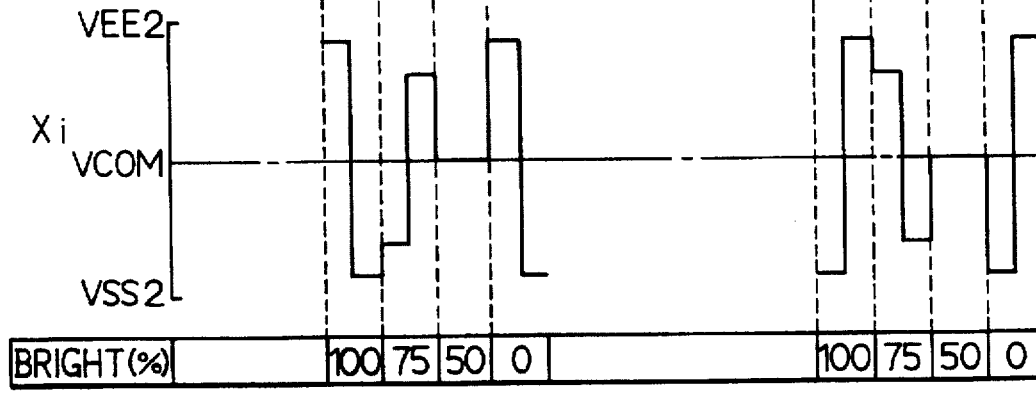
Figure 14A:
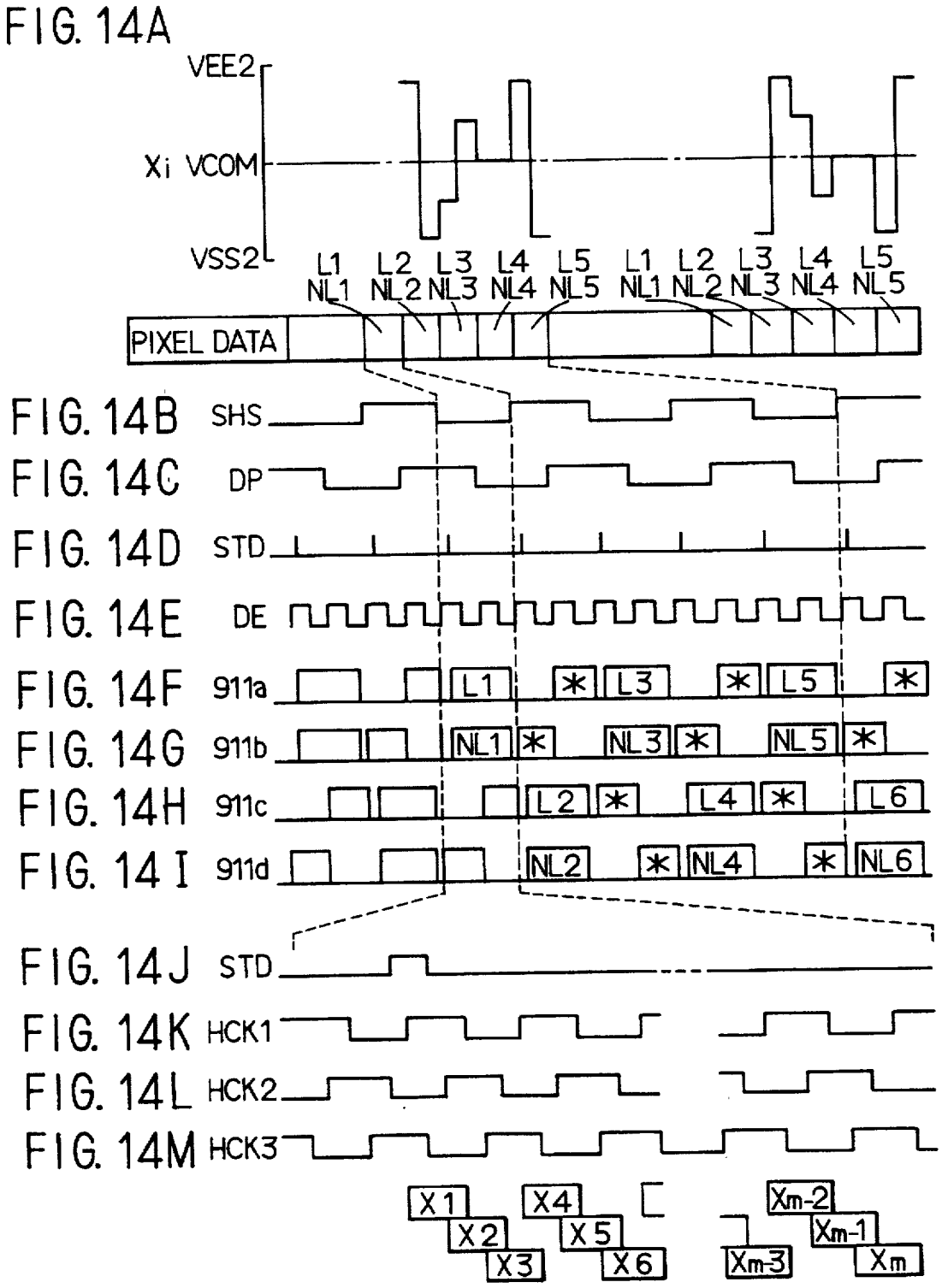
Figure 15:
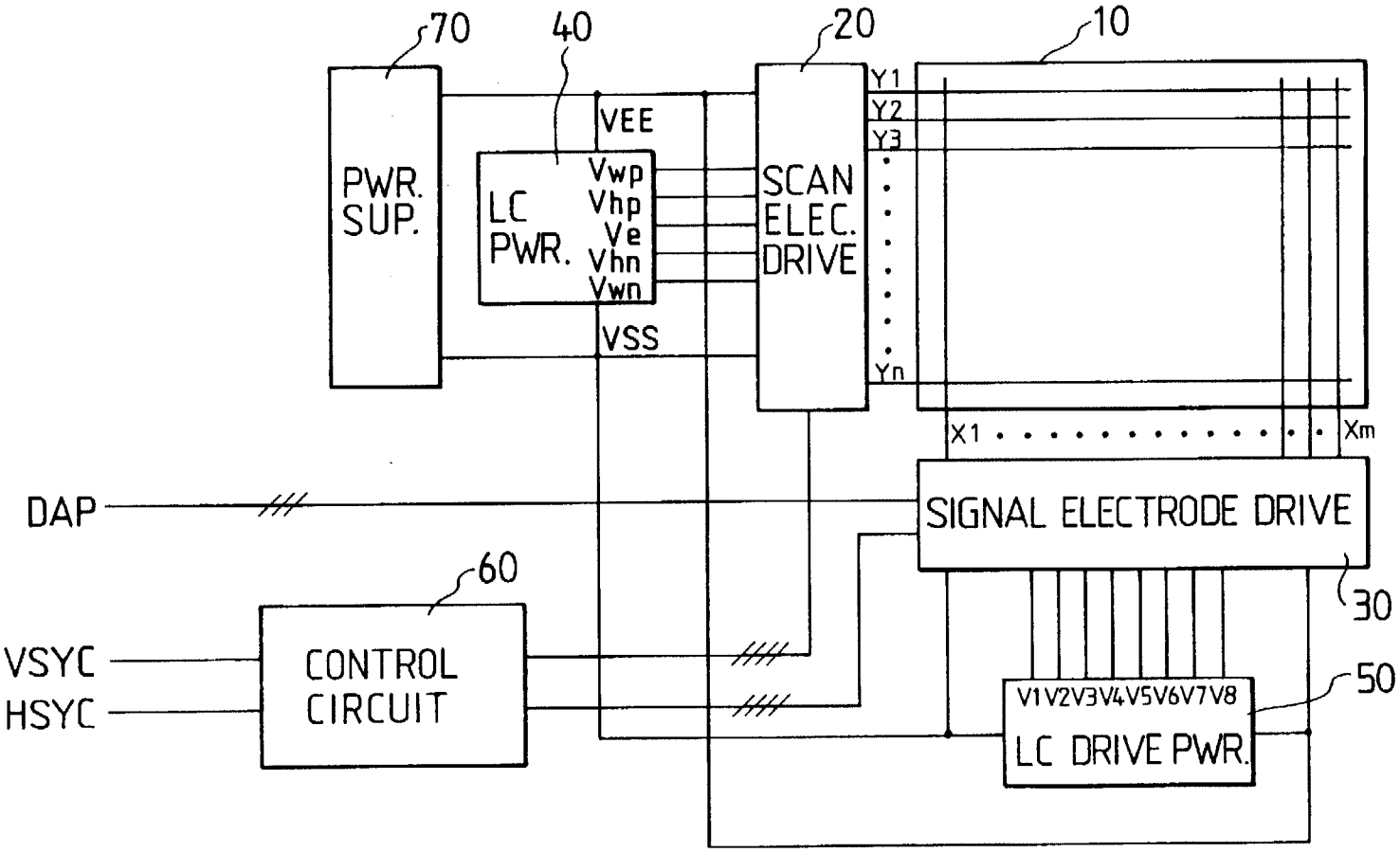
FIG. 15 PRIOR ART
FIG. 15 is an overall structural diagram showing the entire structure of a liquid crystal display device of the prior art.
Figure 16A:
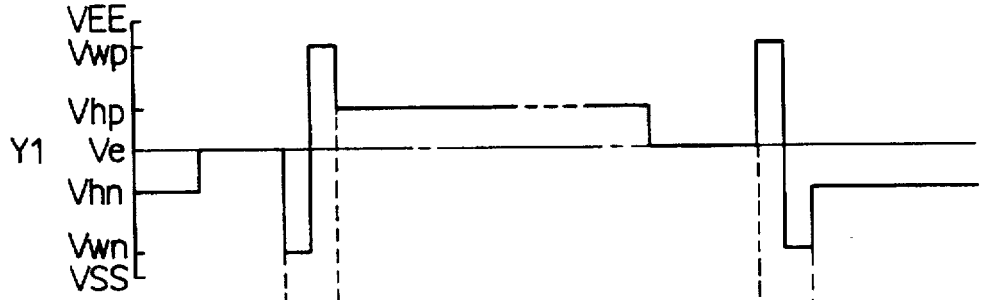
PRIOR ART FIG. 16A
FIGS. 16A–16D are waveform diagrams showing the waveforms of a scanning signal and data signal in the structure of the prior art.
Figure 16B:
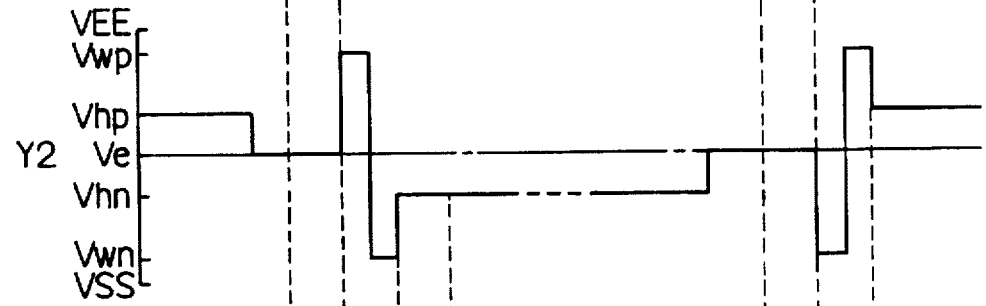
Figure 16C:
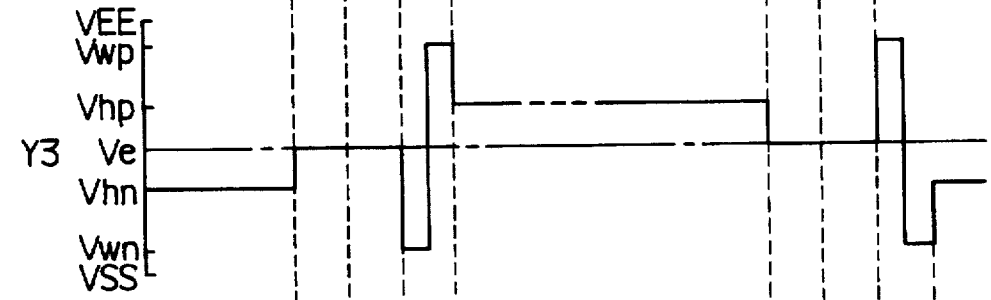
Figure 16D:
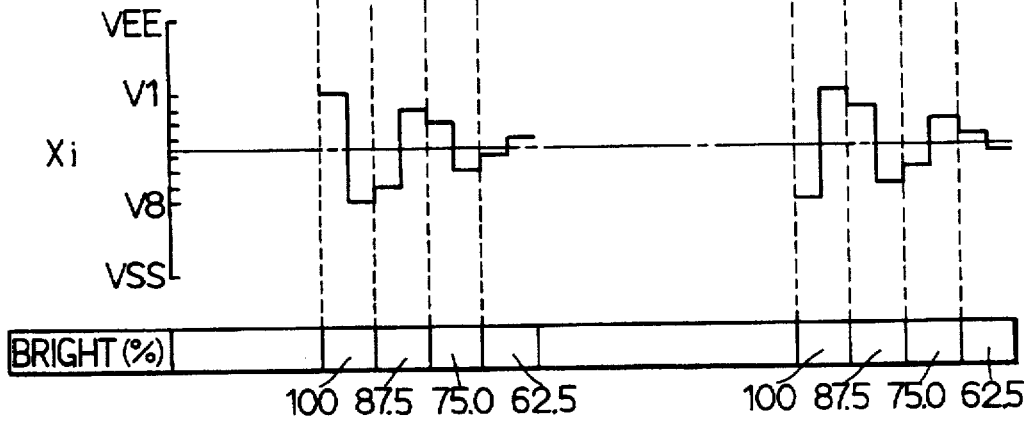

FIG. 12 shows the structure of the analog sampling circuits. Each of the analog sampling circuits are provided with sample and hold circuits 911*a*–911*d* comprising hold capacitors and analog switches, and sample and hold the image signal voltages.

The sample and hold circuits 911*a* and 911*c* sample and hold the positive image signal voltages, while the sample and hold circuits 911*b* and 911*d* sample and hold the negative image signal voltages. Also, the combination of sample and hold circuits 911*a* and 911*b* and the combination of sample and hold circuits 911*c* and 911*d* are alternately switched from hold states to sampling states of the image signal voltages so that when one pair thereof outputs a hold signal in a sustaining state the other samples the image signal voltages of the next scanning line. This switching is performed by a signal SHS (refer to FIG. 14B) which switches each scanning line to high and low, via a switching circuit 912.

Note that a signal which samples the image signal voltages is output from the switching circuit 912 to the group of sample and hold circuits which is in a sampling state in response to the sampling timing signal input to the SK terminal described above. Also, the analog switches 913*a* and 913*b* are controlled by the above-described DP signal which indicates the polarities of the scanning electrodes, and image signal voltages for holding positive or negative polarities are output from the group of sample and hold circuits which are in a hold state.

Further, an analog switch 914 is controlled by the SHS signal which performs output selection for each scanning line, and finally the image signal voltages are selected by these analog switches 913*a*, 913*b* and 914. The above operation is performed with respect to the analog sampling switches 91*a*–91*m*, these image signal voltages being simultaneously output from X1 to Xm by means of the high timing of an OE signal from the control circuit 60.

Note that in FIGS. 14A–14M, where the image data of all pixels arrayed on the jth scanning electrode input by the positive image signal voltages VR, VG and VB are taken as Lj and the image data of all pixels arrayed on the jth scanning electrode input by the negative image signal voltages NVR, NVG and NVB are taken as NLj, the image signal voltages thereof are sampled by the sample and hold circuits 911*a*–911*d* in sequence from the data L1 and NL1 of all pixels arrayed on the first scanning electrode, and indicate output timing.

In the above-described structure, the SCC and DP signals of the scanning electrode drive circuit 20 and the SHS, DP and OE signals of the signal electrode drive circuit 90 are synchronized and the liquid crystal waveforms shown in FIGS. 13A–13D are realized by inputting image data of pixels arrayed on a scanning electrode in a given selection period in the selection period one previous thereto. In this second embodiment, the positive signal voltages VR, VG and VB and the negative signal voltages NVR, NVG and NVB output from the level conversion circuit 100 are symmetrical voltages around the output voltage Ve of the liquid crystal drive voltage power supply circuit 40, i.e., the reference voltage VCOM. Further, because the hold capacitors in the sample and hold circuits 911*a*–911*d* are connected to the reference voltage VCOM, the image signal voltages input via the analog switches are latched with the reference voltage VCOM as a reference.

Accordingly, even if the output voltages VEE1, VSS1, VEE2 and VSS2 of the power supply circuits 70 and 80 fluctuate for example, because the image signal voltages make the reference voltage VCOM a reference and the signal electrode drive circuit 90 samples the reference voltage VCOM as a reference, the liquid crystal drive voltages do not fluctuate relative to each other and application of a direct current voltage component to the liquid crystals can be prevented also in this second embodiment.

Note that although a liquid crystal panel 10 which employs antiferroelectric liquid crystals is shown in the above-described embodiments, one which utilizes ferroelectric or other types of liquid crystals may also be applied to the present invention.

Although the present invention has been fully described in connection with the preferred embodiment thereof with reference to the accompanying drawings, it is to be noted that various changes and modifications will become apparent to those skilled in the art. Such changes and modifications are to be understood as being included within the scope of the present invention as defined by the appended claims.

What is claimed is:

1. A matrix-type liquid crystal display device comprising:

a liquid crystal panel having a first set of n strip-shaped electrodes and a second set of m strip-shaped second electrodes, said first and second sets of electrodes being disposed perpendicular to each other and having pixels disposed at intersections therebetween for performing matrix display;

a first electrode driving circuit for applying a signal to said first set of electrodes; and a second electrode driving circuit for applying a signal to said second set of electrodes;

a first electrode power supply circuit for generating first electrode driving voltages to power said first electrode driving circuit; and a second electrode power supply circuit, separate from said first electrode power supply circuit, for generating second electrode driving voltages to power said second electrode driving circuit;

wherein each of said first electrode driving voltages and said second electrode driving voltages include a respective central voltage; and said second electrode power supply includes an equalizing circuit for equalizing said central voltage of said first electrode driving voltages and said central voltage of said second electrode driving voltages.

2. The matrix-type liquid crystal display device of claim 1, further comprising:

a scanning signal power supply circuit for outputting plural level scanning signal production voltages;

wherein said first electrode driving circuit selects said plural level scanning signal production voltages to produce and output said first electrode driving circuit signal; and one of said plural level scanning signal production voltages is a remaining central voltage of said scanning signal production voltages and said central voltage is a central voltage of said first electrode driving circuit signal.

3. The matrix-type liquid crystal display device according to claim 2, further comprising:

a data signal power supply circuit for outputting plural level data signal production voltages;

wherein said first electrode driving circuit selects said plural level data signal production voltages to produce and output said second electrode driving circuit signal; and said data signal power supply circuit comprises circuit means for matching said central voltage of said scanning signal production voltage and a central voltage of said plural level data signal production voltages.

4. The matrix-type liquid crystal display device according to claim 2, further comprising:

an amplifier circuit for amplifying an image data signal input from an external source and outputting an image signal voltage;

wherein said second electrode driving circuit samples and inputs said image signal voltage from said amplifier circuit and outputs said data signal; and said amplifier circuit amplifies said image data signal with said central voltage of said scanning signal production voltage as a reference.

5. The matrix-type liquid crystal display device according to claim 4, wherein said second electrode driving circuit comprises a holding capacitor for holding said sampling input image signal voltage, said holding capacitor holding said image signal voltage with said central voltage of said scanning signal production voltage as a reference.

6. A matrix-type liquid crystal display device comprising:

a liquid crystal panel having a first set of n strip-shaped scanning electrodes and a second set of m strip-shaped signal electrodes, said first and second sets of electrodes being disposed perpendicular to each other and having pixels disposed at intersections therebetween for performing matrix display;

a scanning electrode driving circuit for applying a scanning signal to said first set of n electrodes;

a signal electrode driving circuit for applying a data signal to said second set of m electrodes;

a scanning signal power supply circuit for outputting plural level scanning signal production voltages for producing said scanning signal;

a data signal power supply circuit for outputting plural level data signal production voltages for producing said data signal;

a first power supply circuit for performing power supply to said scanning electrode driving circuit and said scanning signal power supply circuit; and a second power supply circuit for supplying power to said signal electrode driving circuit and said data signal power supply circuit;

wherein an average of said plural level scanning voltages is approximately equal to an average of said plural level data signal production voltages.

7. A matrix-type liquid crystal display device comprising:

a liquid crystal panel having a first set of n strip-shaped scanning electrodes and a second set of m strip-shaped signal electrodes, said first and second sets of electrodes being disposed perpendicular to each other and having pixels disposed at intersections therebetween for performing matrix display;

a scanning electrode driving circuit for applying a scanning signal to said first set of n scanning electrodes;

a signal electrode driving circuit for applying a data signal to said second set of m signal electrodes;

a scanning signal power supply circuit for outputting plural level scanning signal production voltages for producing said scanning signal;

a first power supply circuit for performing power supply to said scanning electrode driving circuit and said scanning signal power supply circuit;

a second power supply circuit for performing power supply to said signal electrode driving circuit; and an amplifier circuit for amplifying an image data signal input from an external source and outputting an image signal voltage;

wherein said signal electrode driving circuit samples and inputs an image signal voltage from said amplifier circuit and outputs said data signal; and said amplifier circuit amplifies said image data signal with a predetermined level scanning signal production voltage output from said scanning signal power supply circuit as a reference.

8. The matrix-type liquid crystal display device according to claim 7, wherein said signal electrode driving circuit has a holding capacitor for holding a sampling input image signal voltage, said holding capacitor holding said image signal voltage with said predetermined level scanning signal production voltage as a reference.

9. A matrix-type liquid crystal display device comprising:

a liquid crystal panel having a first set of n strip-shaped scanning electrodes and a second set of m strip-shaped signal electrodes, said first and second sets of electrodes being disposed perpendicular to each other and having pixels disposed at intersections therebetween for performing matrix display;

scanning electrode driving means for applying a scanning signal to said first set of n scanning electrodes;

signal electrode driving means for applying a data signal to said second set of m signal electrodes;

a scanning electrode power supply for powering said scanning electrode driving means;

a signal electrode power supply, separate from said scanning electrode power supply, for powering said signal electrode driving means;

wherein said scanning electrode driving means comprises a scanning signal power supply circuit for outputting a power supply voltage for producing said scanning signal and a scanning electrode driving circuit for producing and outputting said scanning signal by means of said power supply voltage from said scanning signal power supply circuit; and said signal electrode driving means obtains voltage information indicating a state of a power supply voltage of said scanning signal power supply circuit and produces said data signal based on said voltage information.

10. The matrix-type liquid crystal display device according to claim 9, wherein:

said scanning signal power supply circuit is for outputting output power supply voltages having a plurality of voltage levels; and said signal electrode driving means obtains a predetermined voltage level among said plural voltage levels as said voltage information and produces said data signal with that voltage level as a reference.

11. A matrix-type liquid crystal display device comprising:

a liquid crystal panel having a first set of n strip-shaped scanning electrodes and a second set of m strip-shaped signal electrodes, said first and second sets of electrodes being disposed perpendicular to each other and having pixels disposed at intersections therebetween for performing matrix display;

scanning electrode driving means for applying a scanning signal to said first set of n scanning electrodes; and signal electrode driving means for applying a data signal to said second set of m signal electrodes;

a scanning electrode power supply for powering said scanning electrode driving means;

a signal electrode power supply, separate from said scanning electrode power supply, for powering said signal electrode driving means;

wherein said signal electrode driving means includes modifying means for direct current modifying only a fluctuating portion of said data signal when said scanning signal direct current fluctuates.

12. A matrix-type liquid crystal display device comprising:

a liquid crystal panel having a first set of n strip-shaped electrodes and a second set of m strip-shaped second electrodes, said first and second sets of electrodes being disposed perpendicular to each other and having pixels disposed at intersections therebetween for performing matrix display;

a first electrode driving circuit for applying a signal to said first set of electrodes; and a second electrode driving circuit for applying a signal to said second set of electrodes;

a first electrode power supply circuit for generating first electrode driving voltages to power said first electrode driving circuit, said first electrode driving voltages including a central voltage component, one of said first electrode driving voltages having a first polarity with respect to said central voltage component and others of said first electrode driving voltages having a polarity opposite that of said first polarity;

a second electrode power supply circuit, separate from said first electrode power supply circuit, for receiving said central voltage component and for generating second electrode driving voltages to power said second electrode driving circuit, one of said second electrode driving voltages having a first polarity with respect to said central voltage component and others of said second electrode driving voltages having a polarity opposite that of said first polarity.

* * * * *